US005474007A

United States Patent [19]

Kobayashi

[11] Patent Number: 5,474,007

[45] Date of Patent: Dec. 12, 1995

[54] CONTROL SYSTEM FOR WATERCRAFT

[75] Inventor: Noboru Kobayashi, Iwata, Japan

[73] Assignee: Yamaha Hatsudoki Kabushiki Kaisha, Iwata, Japan

[21] Appl. No.: 367,943

[22] Filed: Jan. 3, 1995

Related U.S. Application Data

[63] Continuation of Ser. No. 159,446, Nov. 29, 1993, abandoned.

[51] Int. Cl.[6] ..... B63H 11/113

[52] U.S. Cl. ..... 440/42; 114/270

[58] Field of Search ..... 114/145 R, 145 A, 114/150, 270, 284, 285–287; 440/38–42, 113; 239/265.27, 265.35

[56] References Cited

U.S. PATENT DOCUMENTS 5,062,815 11/1991 Kobayashi ..... 440/87

5,092,260 3/1992 Mardikian ..... 114/285

*Primary Examiner*—Edwin L. Swinehart

*Attorney, Agent, or Firm*—Knobbe, Martens, Olson & Bear

[57] ABSTRACT

A control for a watercraft powered by a jet propulsion unit and having a reverse thrust bucket. In order to permit the operator to easily use the reverse thrust bucket for trim and retardation, a control lever is mounted on the steering handlebar assembly in close relationship to one of the handle grips. A mechanism interconnects the control lever to the reverse thrust bucket and includes a motion amplifying mechanism so that a small degree of movement of the control lever will be transmitted into a large degree of movement of the reverse thrust bucket.

12 Claims, 3 Drawing Sheets

CONTROL SYSTEM FOR WATERCRAFT

CROSS-REFERENCE TO RELATED APPLICATION

This application is a continuation of my application Ser. No. 08/159,446, filed Nov. 29, 1993 and assigned to the assignee hereof now abandoned.

BACKGROUND OF THE INVENTION

This invention relates to a control system for a watercraft, and more particularly to an improved control mechanism for the reverse thrust bucket of a watercraft propelled by a jet propulsion unit.

As is well-known, most types of watercraft without a reverse drive are very difficult to bring to a halt in a short time period. With propeller driven watercraft embodying a forward, neutral, reverse transmission, retardation can be accomplished by shifting the transmission from a forward drive mode into a reverse drive mode. This even takes some time, however, since the engine must be decelerated before the transmission can be shifted into the reverse drive mode.

It has been discovered that jet-propelled watercraft embodying reverse thrust buckets can be readily decelerated through the shifting of the reverse thrust bucket into its reverse position and the acceleration of the driving speed of the jet propulsion unit. Even more importantly, the trim of a jet propelled watercraft can be readily adjusted by utilizing the reverse thrust bucket. If the reverse thrust bucket is moved from a forward drive position toward a reverse drive position, trim of the watercraft can actually be adjusted. However, the control for the reverse thrust bucket is normally positioned at a remote location from the other watercraft controls so as to avoid its inadvertent operation. This renders it unsuitable for retardation and trim adjustment purposes, for the most part.

It is, therefore, a principal object of this invention to provide an improved control system for a watercraft.

It is a further object of this invention to provide an improved trim system for watercraft and a control therefor.

It is a further object of this invention to provide an improved operator control for the reverse thrust bucket of a jet-propelled watercraft.

In normal application of the reverse thrust bucket, the control lever can move through a large degree of movement because the shifting into reverse is done only infrequently. However, when the reverse thrust bucket is to be employed for a retardation purposes, it is desirable that the operator need only move the actuator through a small distance. The previously proposed reverse thrust bucket actuating mechanisms have not permitted this goal to be attained.

It is, therefore, a still further object of this invention to provide an improved reverse thrust bucket actuating mechanism wherein the operator for the reverse thrust bucket need only move a small amount to shift the reverse thrust bucket from its forward drive position to its reverse drive position.

It is another object of this invention to provide an operating mechanism for the reverse thrust bucket of a jet propulsion unit, which offers a significant mechanical advantage.

It is a further object of this invention to provide an improved trim adjustment arrangement for a jet propelled watercraft.

SUMMARY OF THE INVENTION

A first feature of the invention is adapted to be embodied in a watercraft having a handlebar control for steering of the watercraft. A control lever is pivotally supported on one of the handlebars and is operatively connected to a propulsion device for controlling the forward speed and/or trim of the watercraft so that the operator can operate the control without removing his hands from the handlebar. Another control lever for the engine speed is pivotally supported on the other handlebar. The control levers have different lengths.

Another feature of the invention is adapted to be embodied in a mechanism for operating a reverse thrust bucket of a marine jet propulsion unit. A control lever is provided and is operatively connected to the reverse thrust bucket for moving it between its positions. This interconnecting mechanism includes a device for multiplying the movement of the operating lever into a greater degree of movement of the reverse thrust bucket.

DETAILED DESCRIPTION OF THE PREFERRED EMBODIMENT OF THE INVENTION

Figure 1:
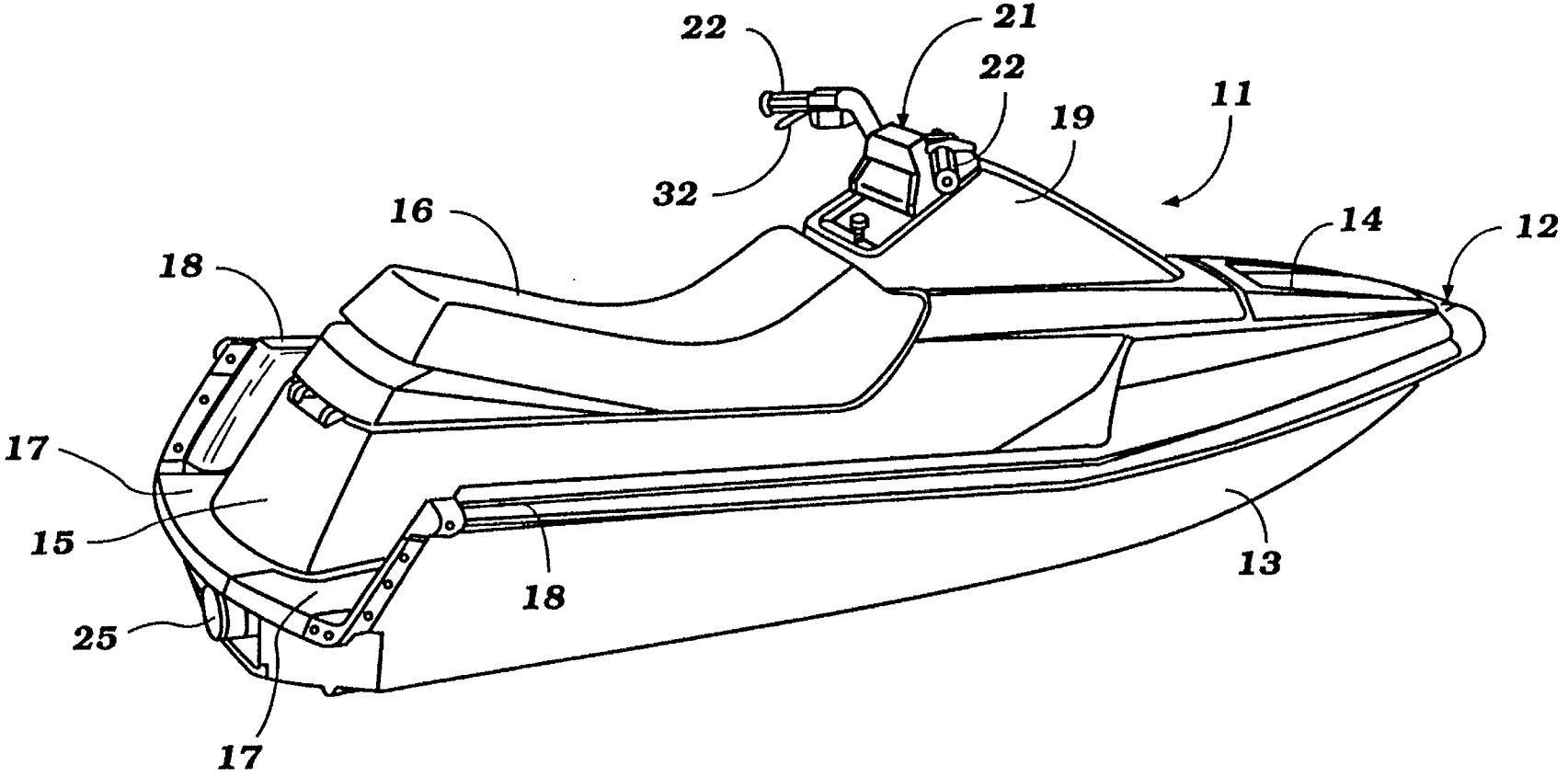
FIG. 1 is a perspective view of a watercraft constructed in accordance with an embodiment of the invention, taken from the rear and side.

Referring first in detail to FIG. 1, a watercraft constructed in accordance with an embodiment of the invention is identified generally by the reference numeral 11. It is to be understood that the type of watercraft depicted is just typical of one of many types of watercraft that may practice the invention. The invention is particularly adapted for use with watercraft having jet propulsion units, and the type of watercraft illustrated is one of that frequently is powered by such propulsion units.

The watercraft 11 is comprised of a hull, indicated generally by the reference numeral 12, that is made up of a lower hull portion 13 and an upper deck portion 14. The hull and deck portions 13 and 14 are formed from any suitable material, such as a molded fiberglass reinforced resin or the like.

The deck portion 14 has a raised pedestal 15 on which a seat 16 is positioned. On opposite sides of the pedestal 15, the deck 14 is provided with a pair of foot areas 17, which open through the rear of the watercraft. This permits the watercraft to be operated by one or more riders seated in straddle-tandem fashion on the seat 16. Also, the rear opening of the foot area 17 permits water that may enter into the rider's area to drain back out. This also facilitates entry of the watercraft 11 from the rear.

The outer sides of the foot area 17 are defined by raised gunnels 18, which terminate at a position slightly below the upper end of the pedestal 15 and seat 16.

The area forward of the seat 16 defines an engine compartment in which a powering internal combustion engine (not shown) of any known type is positioned. This engine area is accessible by means of a removable hatch cover 19, which also supports a handlebar assembly, indicated generally by the reference numeral 21, for control of the watercraft 11. The handlebar assembly 21 has a pair of spaced-apart handgrips 22, which the operating rider may grasp for steering of the watercraft.

Figure 2:
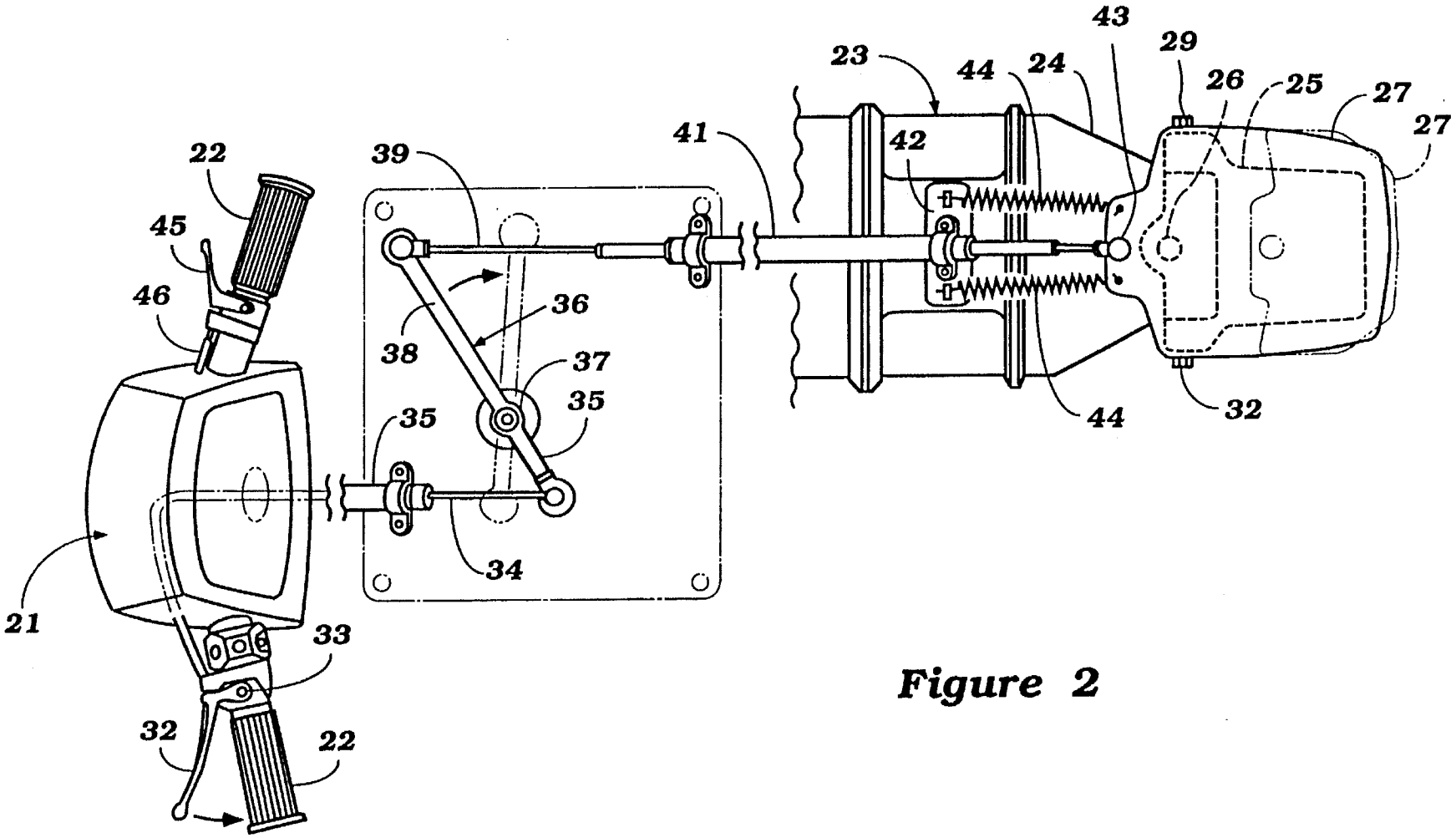
FIG. 2 is a top plan view showing the operating mechanism for the reverse thrust bucket.
Figure 3:
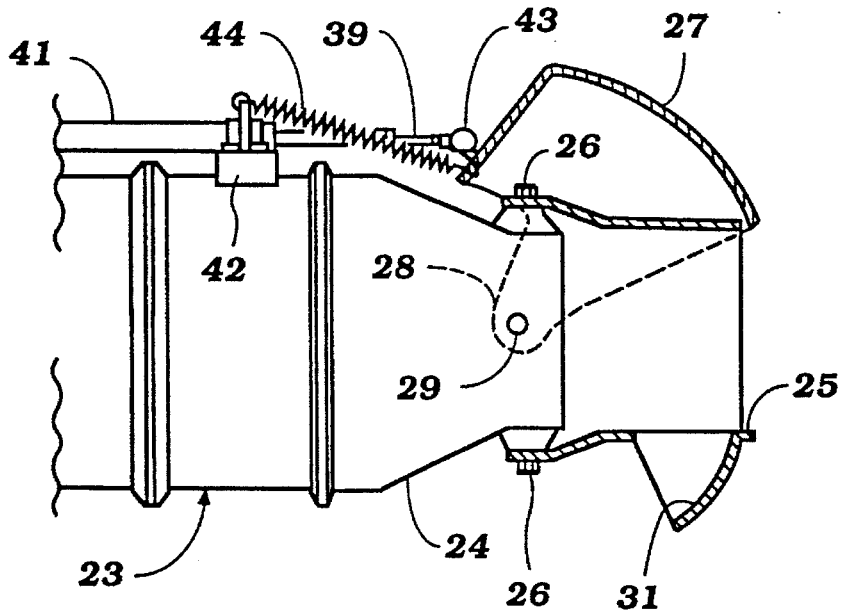
FIG. 3 is a partial cross-sectional view showing the reverse thrust bucket in its forward drive position.
Figure 4:
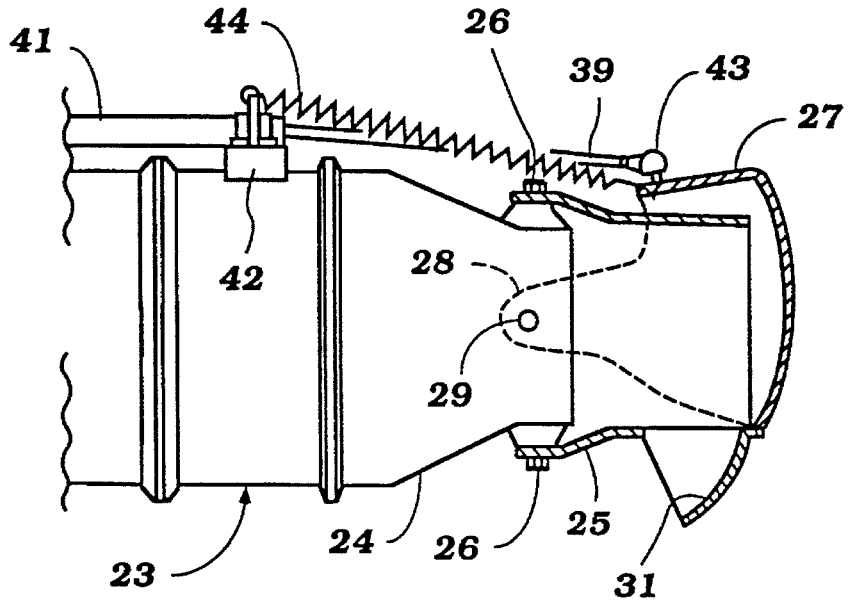
FIG. 4 is a side elevational view, with portions shown in cross-section, showing the mechanism in its reverse thrust position.

The area beneath the seat 16, and specifically the underside of the lower hull portion 13, is formed with a tunnel in which a jet propulsion unit of any known type may be positioned, and this jet propulsion unit is shown partially in FIGS. 2–4 and is identified generally by the reference numeral 23. The jet propulsion unit 23 has a downwardly facing water inlet through which water is drawn by an impeller driven by the aforenoted engine. This water is then discharged rearwardly through a discharge nozzle 24 for propulsion of the watercraft 11 in a well-known manner.

A steering nozzle 25 is pivotally supported at the end of the discharge nozzle 24 about a vertically extending axis by upper and lower pivot bolts 26. As is well-known in this art, pivotal movement of the steering nozzle 25 is effective to change the direction of travel of the watercraft. The handlebar assembly 21 is connected to the steering nozzle 25 in any well-known manner for its steering operation.

A reverse thrust bucket 27 has a pair of side portions 28 that have pivotal connections to the rear end of the steering nozzle 24 provided for by pivot pins 29. The reverse thrust bucket 27 is movable between a forward drive position, as shown in FIG. 3 where it is clear of the discharge end of the steering nozzle 26, through a plurality of intermediate positions to a reverse drive position, as shown in FIG. 4 where the discharge end of the steering nozzle 25 is occluded. A reverse water discharge spout 31 is formed on the lower end of the steering nozzle 24, and when the reverse thrust bucket 27 is in its reverse drive position, the water pumped by the impeller will be discharged in a forward direction so as to provide a reverse driving force on the watercraft. This reverse driving force is employed for effecting a retardation operation, as well as reverse operation. The intermediate positions or at least those close to the forward drive position may be employed by the operator to adjust the trim condition of the watercraft.

In order to permit the operator to control the reverse/thrust bucket without removing his hand from the handlebar assembly 27, a reverse thrust bucket control lever 32 is pivotally supported adjacent one of the handel grips 22 by means of a mounting assembly including a pivot pin 33. The bucket control lever 32 is connected to one end of a wire actuator 34, which is contained within a protective sheath 35. The opposite end of the wire actuator 34 is connected to the shorter arm 35 of a lever, indicated generally by the reference numeral 36, and which is pivotally mounted on a pivot pin 37 at a convenient location within the hatch cover 17.

A longer arm 38 of the lever 36 is connected to one end of a further wire actuator 39, which is also encircled for the major portion of its length by a protective sheaf 41. The rear end of the sheaf 41 is affixed to the jet propulsion unit 23 by a fastener 42. The rear end of the wire actuator 39 is connected to the reverse thrust bucket 27 by means of a connector 43.

Since the lever 36 has different lengths, with the shorter end being connected to the bucket control lever 32, and the longer end connected to the reverse thrust bucket 27, a small degree of pivotal movement of the reverse thrust bucket operating lever 32 will effect large movement of the reverse thrust bucket 27 particularly that from its forward drive position to its reverser drive position. Thus, the operator need not operate the lever 32 to any great extent so as to shift into reverse or, more importantly, to move the reverse thrust bucket 27 to its reverse position for retardation purposes.

In order to ensure that the reverse thrust bucket 27 will normally be maintained in its forward drive position, there are provided a pair of tension springs 44 that are loaded between the bracket 42 and the reverse thrust bucket 27 so as to normally urge it to its forward drive position, as shown in FIG. 3.

A throttle control lever 45 is mounted on the other side of the handlebar assembly 21 adjacent the other handgrip 22. A bowden wire actuator 46 connects the throttle control lever 45 to the throttle control of the engine, which drives the jet propulsion unit 23 in a well-known manner. It should be noted that the reverse thrust bucket control lever 32 is substantially longer than the throttle control lever 45 so the operator can readily distinguish which control is which. This also provides added mechanical advantage for the operator in operating the reverse thrust bucket.

It should be readily apparent that the described construction permits the watercraft 11 to be not only shifted into reverse easily, but also to be shifted into reverse for retardation or trim control without necessitating the operator removing his hands from the handlebar assembly 22 or, for that matter, from releasing the throttle control lever 45 to achieve even a greater retardation effect. Also, the mechanical advantage of the lever system that interconnects the reverse thrust bucket control lever 32 to the reverse thrust bucket 27 amplifies the movement of the thrust bucket so that the operator need not move the reverse thrust bucket control lever 32 very far to achieve the retardation operation.

It is to be understood that the foregoing description is that of a preferred embodiment of the invention and that various changes and modifications may be made without departing from the spirit and scope of the invention, as defined by the appended claims.

I claim:

1. A watercraft having a jet propulsion unit, a handlebar assembly having a pair of oppositely extending handle bars for controlling the steering of the watercraft, a reverse thrust bucket for said jet propulsion unit, a reverse thrust bucket control lever mounted on one of said handlebars for operating said reverse thrust bucket and pivoted about a first transverse axis perpendicular to an axis defined by said one handlebar, and a throttle control lever mounted on the other of said handlebars for controlling the speed at which said jet propulsion unit is driven and pivoted about a second transverse axis perpendicular to an axis defined by the other of said handlebars.

2. The watercraft of claim 1, wherein the reverse thrust bucket control lever has a different length than the throttle control lever.

3. The watercraft of claim 2, wherein the reverse thrust bucket control lever is longer than the throttle control lever.

4. The watercraft of claim 2, wherein a mechanism interconnects the reverse thrust bucket control lever with the reverse thrust bucket, and the interconnecting mechanism has a mechanical advantage for amplifying the degree of movement of the reverse thrust bucket control lever into greater movement of said reverse thrust bucket.

5. The watercraft of claim 1, wherein the jet propulsion unit includes a pivotally supported steering nozzle, and the handlebar assembly is operatively connected to the steering nozzle for steering of the watercraft.

6. The watercraft of claim 5, wherein the reverse thrust bucket is pivotally supported on the steering nozzle for movement between a forward drive position and a reverse drive position and wherein the reverse thrust bucket control lever moves the reverse thrust bucket between its forward drive position and its reverse drive position.

7. The watercraft of claim 6, wherein the reverse thrust control lever has a different length than the throttle control lever.

8. The watercraft of claim 7, wherein the reverse thrust bucket control lever is longer than the throttle control lever.

9. The watercraft of claim 8, wherein a mechanism interconnects the reverse thrust bucket control lever with the reverse thrust, and the interconnecting mechanism has a mechanical advantage for amplifying the degree of movement of the reverse thrust brake control lever into greater movement of the reverse thrust bucket.

10. The watercraft of claim 6, wherein a mechanism interconnects the reverse thrust bucket control lever with the reverse thrust bucket, and the interconnecting mechanism has a mechanical advantage for amplifying the degree of movement of the reverse thrust bucket control lever into greater movement of the reverse thrust bucket.

11. The watercraft of claim 10, wherein the motion amplifying means comprises an interconnecting linkage system.

12. The watercraft of claim 11, wherein the interconnecting linkage system includes a link pivotally supported at a point offset from its ends with the reverse thrust bucket control lever being connected to the shorter ends and the reverse thrust bucket being connected to the longer end.

* * * * *